US007000365B2

(12) United States Patent
Nutley et al.

(10) Patent No.: US 7,000,365 B2
(45) Date of Patent: Feb. 21, 2006

(54) VERTICAL SLEEVE SEALER

(75) Inventors: Christopher L. Nutley, Greendale, IN (US); Jason Hornberger, Lawrenceburg, IN (US)

(73) Assignee: Midwest Service Warehouse, Inc., Lawrenceburg, IN (US)

( * ) Notice: Subject to any disclaimer, the term of this patent is extended or adjusted under 35 U.S.C. 154(b) by 0 days.

(21) Appl. No.: 10/810,938

(22) Filed: Mar. 26, 2004

(65) Prior Publication Data

US 2005/0210833 A1 Sep. 29, 2005

(51) Int. Cl.
*B65B 7/20* (2006.01)

(52) U.S. Cl. ..... 53/397; 53/462; 53/378.3; 53/207; 53/580

(58) Field of Classification Search ..... 53/397, 53/448, 462, 580, 378.3, 207, 209, 222
See application file for complete search history.

(56) References Cited

U.S. PATENT DOCUMENTS 3,016,670 A * 1/1962 Engleson et al. ..... 53/207
3,105,334 A * 10/1963 Marshall ..... 53/378.3
3,415,033 A 12/1968 Perry et al.
3,482,372 A * 12/1969 Hottendorf ..... 53/462
3,530,640 A * 9/1970 Hoffmann ..... 53/209
3,531,905 A * 10/1970 Omori ..... 53/462
3,533,207 A * 10/1970 Jones et al. ..... 53/462
3,572,003 A 3/1971 Perry et al.
3,807,128 A 4/1974 Bauer
3,834,114 A * 9/1974 Johnson ..... 52/462
3,945,560 A 3/1976 Harrelson et al.
3,964,239 A * 6/1976 Elford ..... 53/207
4,463,541 A * 8/1984 Nowacki ..... 53/207
4,887,414 A 12/1989 Arena
4,919,266 A 4/1990 McIntosh, Jr. et al.
5,195,676 A 3/1993 LeBras
5,328,030 A 7/1994 Sutherland
5,671,588 A 9/1997 Chan et al.
5,673,536 A 10/1997 Easter et al.
6,019,220 A 2/2000 Sutherland

* cited by examiner

*Primary Examiner*—John Sipos
(74) *Attorney, Agent, or Firm*—Dinsmore & Shohl LLP

(57) ABSTRACT

A method, apparatus and system are provided for packaging a group of articles into a container formed from a carton blank. The method includes associating a carton blank with a group of articles. The carton blank has at least one open portion and a plurality of bendable flaps. A vertically oriented channel is provided having at least one deflector assembly. The associated carton blank and group are moved vertically in the channel. The movement results in the bending of at least one of the flaps by the deflector assembly such that the carton blank is at least partially assembled around the group. A plow assembly is also provided for the apparatus for packaging a group of articles in a container formed from a carton blank.

25 Claims, 11 Drawing Sheets

VERTICAL SLEEVE SEALER

TECHNICAL FIELD

The present invention relates to packaging methods, apparatuses, and systems for packaging a group of articles into a container formed from a carton blank. More particularly, an associated carton blank and group of articles can be moved vertically through a channel in order that the container can be at least partially assembled around the group of articles in an effective and efficient manner.

BACKGROUND OF THE INVENTION

It is common for consumer articles to be grouped and packaged for sale in bulk. For example, soda cans are often grouped and packaged into cardboard or paperboard "cases" of 12 or 24 cans. To accomplish this packaging, a conventional horizontal packaging system involves mechanical components that associate a cardboard or paperboard carton blank with the cans as they are moving horizontally along a conveyor. The mechanical components then bend and glue flaps of each carton blank during its horizontal movement along the conveyor in order that the cans within the carton blank can be secured therein.

Although a horizontal packaging system can achieve extremely high packaging rates, it typically involves complex machinery that is cost-prohibitive for producing only small to medium quantities or "specialty" packages of packaged articles. On the other hand, the conventional method for packaging small to medium quantities of packaged articles involves hand-loading, and hand-loading has proven to be overly time-consuming and expensive for many of these packaging requirements. Accordingly, there is a need for a cost-effective but sufficiently fast method, apparatus, and system for producing only small to medium quantities of packaged articles.

SUMMARY OF THE INVENTION

It is an aspect of the present invention to provide a cost-effective but sufficiently fast method, apparatus, and system for producing only small to medium quantities of packaged articles. In one exemplary embodiment of the present invention, a method is provided for packaging a group of articles into a container formed from a carton blank. The method includes associating a carton blank with a group of articles. The carton blank has at least one open portion and a plurality of bendable flaps. A vertically oriented channel is provided having at least one deflector assembly. The associated carton blank and group are moved vertically in the channel. The movement results in the bending of at least one of the flaps by the deflector assembly such that the carton blank is at least partially assembled around the group.

In another exemplary embodiment of the present invention, an apparatus is provided for packaging a group of articles in a container formed from a carton blank. The apparatus includes a vertical channel having first and second ends disposed along a substantially vertical longitudinal axis. The first end includes an entrance to the channel and the second end includes an exit from the channel. The entrance is configured to receive a carton blank that is associated with a group of articles and that has a plurality of bendable flaps. A deflector assembly is provided along the channel. The deflector assembly is operative to bend at least one of the flaps as the associated carton blank and group are moved along the vertical channel. The bending results in at least partial assembly of the carton blank around the group.

In yet another exemplary embodiment of the present invention, a system is provided for packaging a group of articles into a container formed from a carton blank. The system includes an article grouping apparatus operative to receive articles and to arrange the articles into a predetermined group. An associating apparatus is operative to associate a carton blank with the group of articles, wherein the carton blank has a plurality of bendable flaps. A vertical sleeve sealer apparatus includes a vertical channel and at least one deflector assembly associated with the channel. The channel has first and second ends disposed along a substantially vertical longitudinal axis. The first end includes an entrance to the channel and the second end includes an exit from the channel. The entrance is configured to receive the associated carton blank and group from the associating apparatus. The deflector assembly is operative to bend at least one of the flaps as the associated carton blank and group are moved along the vertical channel. The bending results in at least partial assembly of the carton blank around the group.

In still another exemplary embodiment of the present invention, a plow assembly is provided for an apparatus for packaging a group of articles in a container formed from a carton blank. The plow assembly is operative to partially assemble a carton blank around an associated group of articles as the associated carton blank and group are moved vertically through a vertical channel of the apparatus. The plow assembly includes at least one mounting structure that is adapted to interface a vertical sleeve sealer apparatus. At least one drafted portion is operative to contact and bend one or more flaps of a carton blank being moved through a channel of a vertical sleeve sealer apparatus. At least one contact surface is operative to at least temporarily maintain a bent position of one or more flaps of a carton blank being moved through a channel of a vertical sleeve sealer apparatus.

One advantage of the present invention is its provision of a cost-effective but sufficiently fast method, apparatus, and system for producing only small to medium quantities of packaged articles. Additional aspects, advantages, and novel features of the invention will be set forth in part in the description as follows, and in part will become apparent to those skilled in the art upon examination of the following or may be learned with the practice of the invention. The aspects and advantages of the invention may be realized and attained by means of the instrumentalities and combinations particularly pointed out in the appended claims.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF EXEMPLARY EMBODIMENTS

Figure 1:
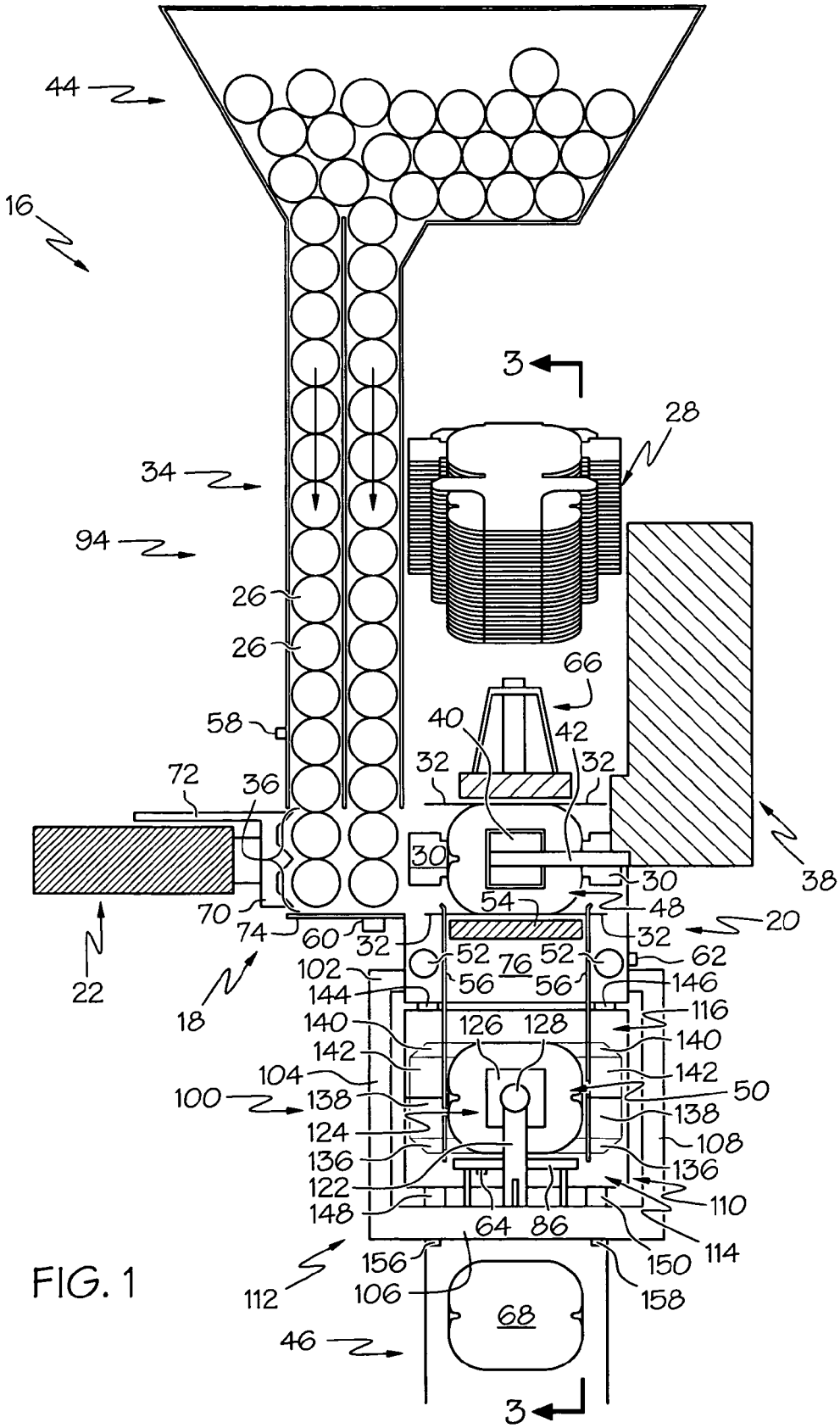
FIG. 1 is a top plan view depicting a packaging system having a vertical sleeve sealer apparatus in accordance with one exemplary embodiment of the present invention.

The present invention and its operation is hereinafter described in detail in connection with the views and examples of FIGS. 1, 2*a*–2*b*, 3–4, 5*a*–5*b*, 6*a*–6*e*, and 7–8, wherein like numbers indicate the same or corresponding elements through the views. Referring to FIG. 1, an exemplary packaging system 16 is depicted as including a platform 44 for receiving articles (e.g., 26) to be packaged. The articles are depicted in FIG. 1 as comprising cans.

As an example, these articles might comprise beverage cans that are sized to hold 8.3 fluid ounces (0.25 Liters). It is common for an 8.3 fluid ounce (0.25 Liter) can to be used to package relatively high-priced and/or high-potency beverages. For example, certain energy or nutritional drinks are advantageously packaged into an 8.3 fluid ounce (0.25 Liter) can because a 12 ounce (0.35 Liter) can of such drinks might not fall within a desirable market price category, and because a 12 ounce (0.35 Liter) serving might be excessive for many consumers. These 8.3 fluid ounce (0.25 Liter) cans may be marketed in four-packs, six-packs, eight-packs, ten-packs, twelve packs, twenty-four packs, and in other particular or specialty groupings.

A conventional horizontal packaging system that is capable of packaging these 8.3 fluid ounce (0.25 Liter) cans may cost between about $100,000 and about $500,000 at this time to purchase, but can be capable of completing between about one hundred and about two hundred packaging cycles per minute. Because the demand for multipacks of 8.3 fluid ounce (0.25 Liter) cans and other specialty packages might be significantly less than the demand for "cases" of 12 ounce (0.35 Liter) cans (e.g., sodas), it may be cost prohibitive to dedicate an expensive conventional horizontal packaging system for packaging the relatively low quantities of 8.3 fluid ounce (0.25 Liter) cans. More particularly, if a horizontal packaging machine were purchased by a packager of 8.3 fluid ounce (0.25 Liter) cans, the machine would likely sit idle for significant periods of time as its packaging capacity may far exceed the demand for such packaged cans, and/or production delays might be necessary to accommodate alternate tooling or reconfiguration for different small or medium quantity applications.

However, the demand for packages of 8.3 fluid ounce (0.25 Liter) cans is often in quantities that exceed those which could be economically packaged by hand (which often achieves between about five and about ten cycles per minute). As a result, a packaging system having a vertical sleeve sealer apparatus in accordance with the present invention can economically satisfy this packaging need, as one exemplary vertical sleeve sealer apparatus might complete between about ten and about thirty packaging cycles per minute, and might cost only slightly more than the hand-packing fixture arrangements. In addition to cost savings, another advantage provided by the vertical sleeve sealer apparatus is its ability to be operated intermittently (as opposed to the continuously operating horizontal packaging machines). Intermittent operation facilitates such important features as simpler maintenance, faster fault correction, and more efficient handling of article loading inconsistencies, for example.

It should be emphasized, however, that a packaging system having a vertical sleeve sealer apparatus need not be limited to packaging 8.3 fluid ounce (0.25 Liter) cans, but might also be configurable to package any of a variety of other cans including, for example, 12 ounce (0.35 Liter) cans. Such a packaging system can also be configurable to receive and package articles other than cans. These other articles might include boxes, bottles, bags, or other containers filled with any of a variety of items such as food products, beverages, health products, beauty products, cleaning products, or lubricants, for example. Alternatively, the articles to be packaged might constitute toys, books, glasses, candles, building supplies, or any of a variety of other items that might advantageously be packaged in bulk (e.g., for shipping purposes or for purchase by a consumer). Furthermore, the articles to be packaged can have virtually any size and shape that is suitable for packaging into a bulk package as described herein.

Figure 3:
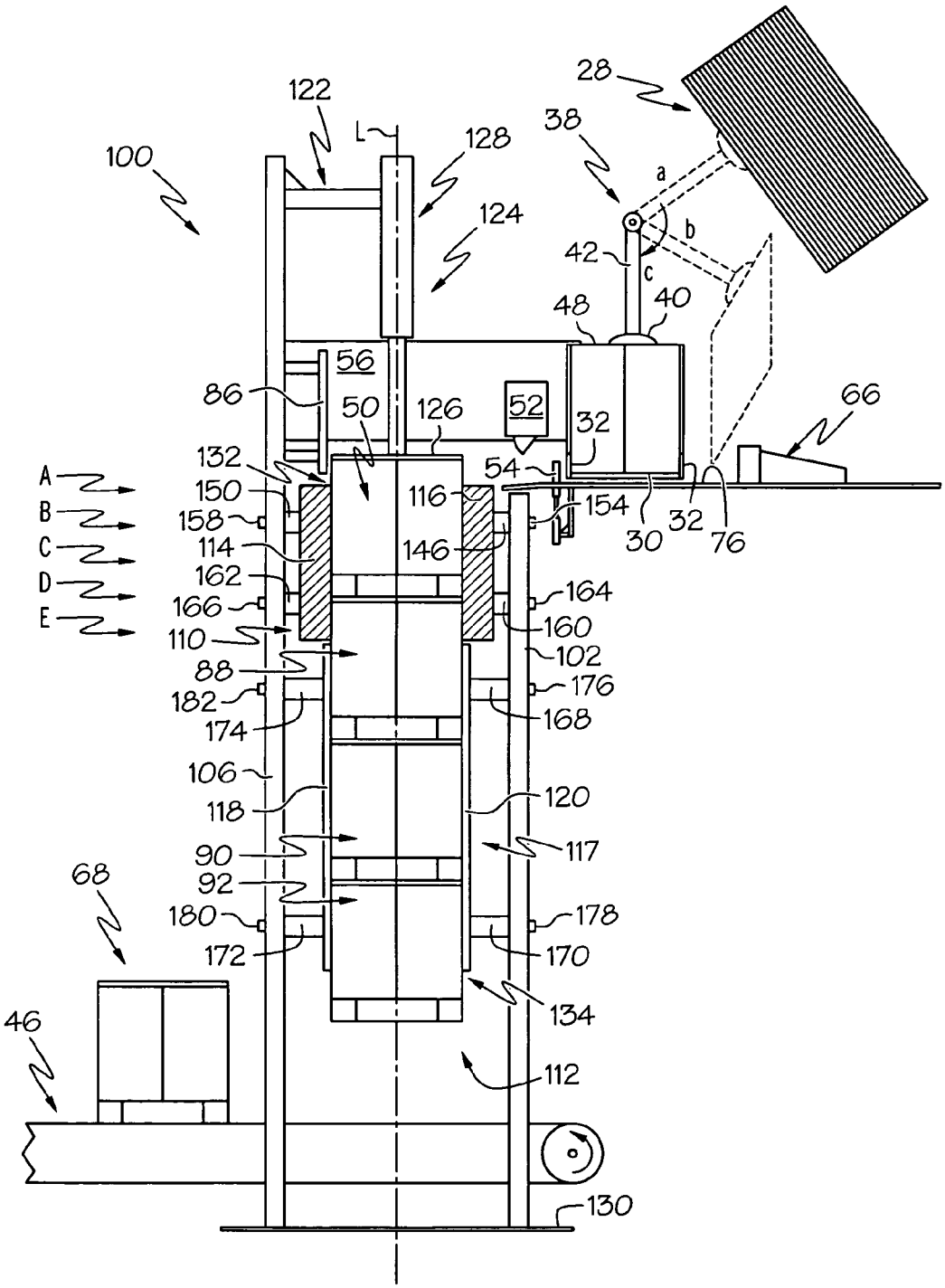
FIG. 3 is a partial cross-sectional view depicting the packaging system of FIG. 1 taken along section line 3—3 thereof illustrating details of an exemplary vertical sleeve sealer apparatus.

Once received at platform 44, articles 26 are shown in FIG. 1 as passing onward into a feed conveyor 34. Feed conveyor 34 can serve as an alignment apparatus 94 for arranging the articles in a desired manner before those articles are associated with a sleeve or carton blank (described below). In the particular example of FIG. 1, feed conveyor 34 is shown to provide two separate and aligned rows of articles to a downstream article grouping apparatus 18. Providing two rows of articles in this manner is particularly appropriate when, as in FIG. 1, the carton blank to be associated is configured to receive two rows of articles. It should, however, be appreciated that a feed conveyor could alternatively provide one row of articles or three or more rows of articles to a downstream article grouping apparatus (e.g., such as when a carton blank to be associated is configured to receive that corresponding number of rows of articles). In any event, feed conveyor 34 can be provided with an end wall 74 that is operative to stop movement of the articles and align them until they are acted upon by article grouping apparatus 18. Although feed conveyor 34 is depicted in FIGS. 1 and 3 as having a substantially horizontal configuration, a vertically oriented feed conveyor might alternatively be provided for arranging the articles in a desired manner before those articles are associated with a sleeve or carton blank.

A proximity sensor 60 (e.g., a photo eye, inductive sensor, capacitive sensor, light curtain, magnetic switch, or a contact switch) or a similar device can be provided to detect when the articles have reached end wall 74 and are accordingly ready for interaction with article grouping apparatus 18. As depicted in FIG. 1, proximity sensor 60 is located such that it can detect when articles within the second row of the feed conveyor 34 have reached end wall 74. Another such proximity sensor might be provided to similarly but independently detect when articles within the first row of the feed conveyor 34 have reached end wall 74. Also, a proximity sensor 58 (e.g., a photo eye, inductive sensor, capacitive sensor, light curtain, magnetic switch, or a contact switch) might be provided to detect when sufficient articles are present within feed conveyor 34 to satisfy an upcoming cycle of article grouping apparatus 18. From the information provided by these proximity sensors, a control system (e.g., 98 in FIG. 7) can determine when a subsequent packaging cycle can begin.

An article grouping apparatus (e.g., 18) can be operative to separate one or more articles into a group that is suitable for association with a carton blank. Any of a variety of hydraulic, electrical, pneumatic, and/or mechanical components can be assembled to provide an article grouping apparatus. In the embodiment depicted in FIG. 1, article grouping apparatus 18 includes a piston cylinder 22 and a piston head 70 being operatively coupled with piston cylinder 22. Piston head 70 can be formed to directly interact with one or more articles on feed conveyor 34 when piston head 70 is selectively extended by piston cylinder 22. In this example, when piston head 70 of FIG. 1 is extended by piston cylinder 22, it is shown to directly engage two articles within the first row of articles provided by feed conveyor 34. These two articles then push against two adjacent and corresponding articles in the second row of articles provided by feed conveyor 34. Accordingly, piston cylinder 22 and piston head 70 can be operative to displace a group 36 of four articles from feed conveyor 34. Group 36 is shown as depicting two rows and two columns of articles. It should, however, be appreciated that alternative embodiments might involve a group of fewer or additional articles that is/are oriented in fewer or additional rows and/or columns, and that piston head 70 can accordingly be configured to interface any of such alternative groups.

Regardless of the specific number of articles to be grouped, piston head 70 might include a blocking arm 72 that is operative to prevent other articles upon feed conveyor 34 from interfering with article grouping apparatus 18 as it operates to separate and displace a group of articles (e.g., 36) from the aligned queue. It should be appreciated, however, that any of a variety of alternative alignment apparatuses and/or grouping apparatuses can be used to prepare groups of articles for association with a carton blank. For example, one of these alternate embodiments might involve two parallel feed conveyors that are disposed upon opposite sides of an erected carton blank to be loaded. Each of these feed conveyors might include only a single row of (e.g., two) articles, although respective article grouping apparatuses can be provided to simultaneously load respective single-row groups from each of the conveyors into the same carton blank (e.g., sized to hold a total of four articles wherein two articles are loaded by each article grouping apparatus). In this manner, the respective single-row groups are pushed together within the carton blank by the respective article grouping apparatuses. By pushing the articles together in this fashion, the loading speed can be increased for two reasons. First, the articles being moved into the carton blank in a first direction are stopped when those articles contact other articles being moved into the carton blank from a second direction. If all of the articles were pushed into the carton blank from a single direction (e.g., as in FIG. 1) at the same increased speed, the articles might have so much inertia that they would not be consistently positioned within the carton blank. In fact, these articles might even be ejected from the opposite end of the carton blank, that is, unless, a stationary, articulating or swinging stopper is provided on the opposite side of the carton blank to prevent this ejection. Second, by reducing the number of article rows that must be moved by a single article grouping apparatus, the required displacement of the article grouping apparatus is reduced and its cycle time can accordingly be significantly increased. Hence, for this additional reason, the provision of multiple feed conveyors and article grouping apparatuses might be desirable for simultaneously loading a single carton blank in order to achieve increased production rates.

Figure 2A:
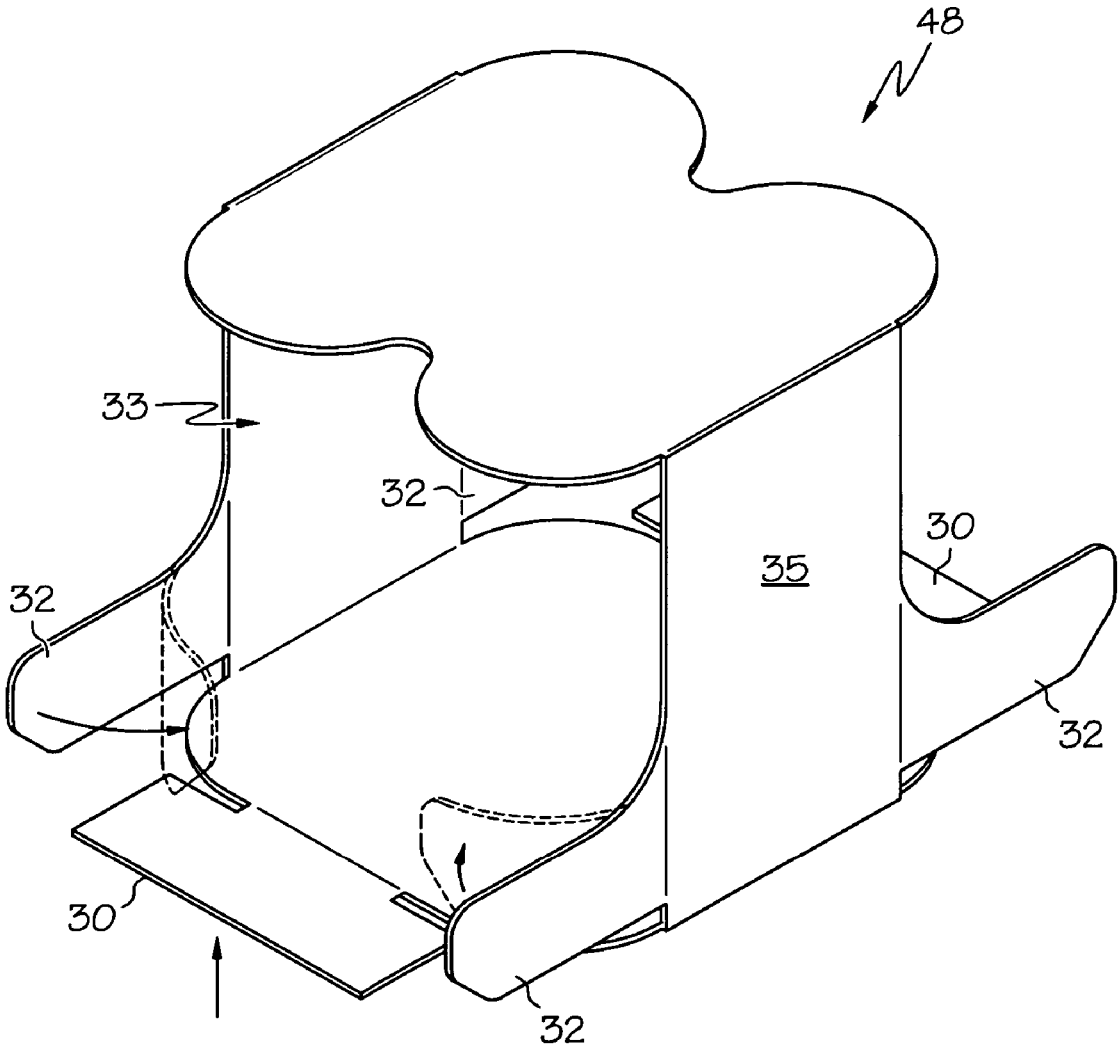
FIG. 2*a* is a top perspective view depicting an erected but partially unassembled carton blank suitable for use in conjunction with the packaging system of FIG. 1.
Figure 2B:
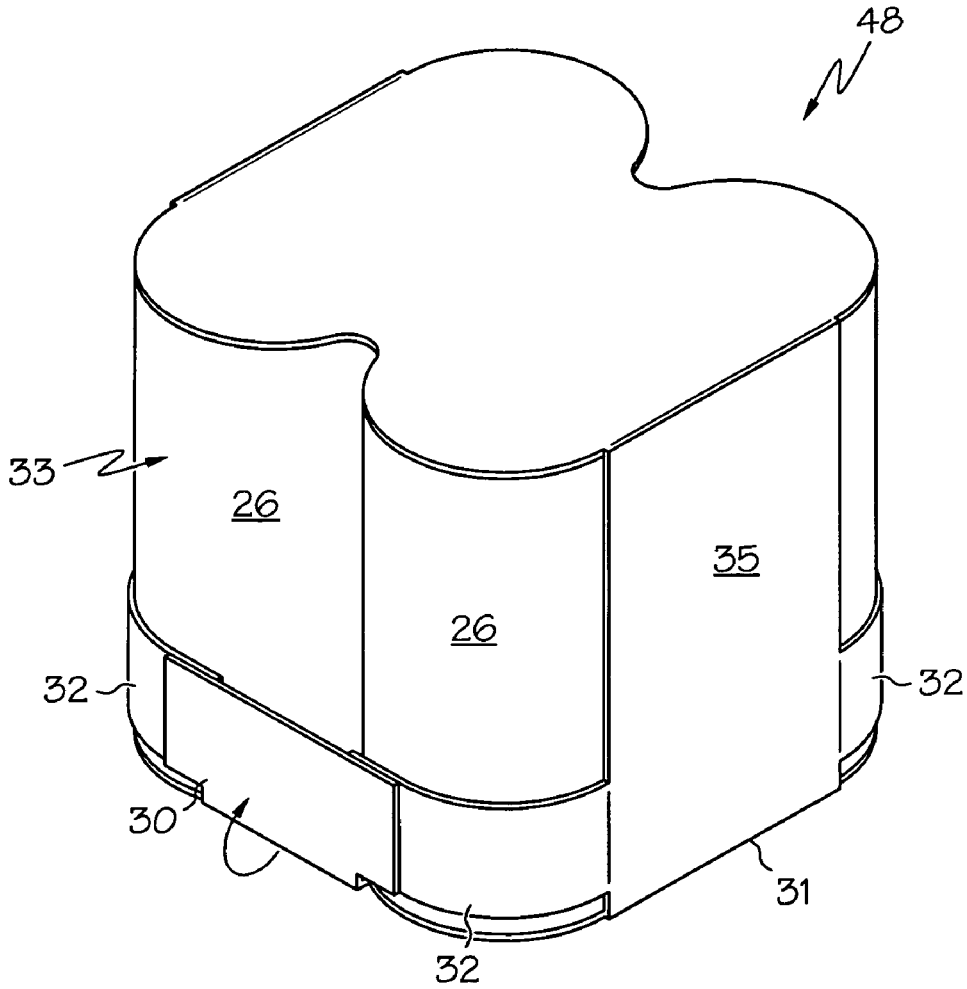
FIG. 2*b* is a top perspective view of the carton blank of FIG. 2*a* being fully assembled around a group of articles.

A carton blank can comprise a piece of paper, cardboard, paperboard, or another suitable material that is stamped or cut from a larger piece of that material. A carton blank can be printed, painted, or covered with one or more decorative laminates to enhance the appearance and/or durability of the carton blank. Although a carton blank is generally manufactured as a flat item, it typically includes one or more sections (e.g., sides or flaps) that can be bent. After the sections of a carton blank are bent, one or more of sections can be attached to each other so that the carton blank can be assembled into a sleeve (e.g., as shown in FIGS. 2*a*–2*b*). Although a sleeve can be formed from more than one carton blank, the sleeve depicted in FIGS. 2*a*–2*b* is depicted as having been formed from a single carton blank. A sleeve can be stored in either a generally flat configuration (e.g., in the carton blank supply bin 28 depicted in FIGS. 1 and 3), but can be erected (e.g., as shown in FIGS. 2*a*–2*b*) in order that articles can be inserted therein. After a sleeve is loaded with articles, remaining unsecured sections of the carton blank (e.g., flaps) can be adhered to each other in order to finalize the assembly of the carton blank around the articles. Respective sections of a carton blank can be attached to each other through use of any of a variety of adhesives including but not limited to glues, tapes, fasteners, welds, and interlocking tabs.

An associating apparatus can be provided for associating the grouped articles with a carton blank and can, for example, involve the insertion of a group of articles into a partially assembled carton blank that has been erected. This partially assembled carton blank is sometimes interchangeably referred to herein as a "sleeve". In the embodiment depicted in FIGS. 1 and 3, an associating apparatus 20 is shown to be at least partially provided by the same piston cylinder 22 and piston head 70 that have already been described as providing article grouping apparatus 18, as these components, in addition to grouping articles, can be further operative to push the grouped articles into an at least partially erected carton blank. Associating apparatus 20 is also shown to include a vacuum placement system 38. Vacuum placement system 38 can include a vacuum arm 42 that is operative to move cyclically and arcurately between two positions. At its first position (position "a" as shown in FIG. 3), vacuum arm 42 can apply a vacuum through its vacuum head 40 to effectively grasp and withdraw a non-erected carton blank 48 from a carton blank supply bin 28. Vacuum arm 42 can then move the withdrawn carton blank 48 (through position "b" as shown in FIG. 3) arcurately to the delivery position (position "c" as shown in FIG. 3) at which carton blank 48 may strike a dead plate 54. Through this arcurate movement, carton blank 48 can begin to be partially erected by unfolding under force of gravity, but then may be fully erected (if not already) upon striking dead plate 54. A group of articles (e.g., 36) can then be inserted into an open portion of the erected carton blank 48 by piston head 70. After group 36 is inserted into erected carton blank 48 (e.g., by piston cylinder 22 and piston head 70), group 36 and carton blank 48 are effectively associated with each other, and vacuum placement system 38 can cease applying a vacuum through its vacuum head 40 to carton blank 48. It should be appreciated, however, that any of a variety of alternative associating apparatuses and processes could be provided.

FIGS. 2*a* and 2*b* depict further details of an exemplary carton blank 48 which might be provided (i.e. partially assembled) in the form of a sleeve. FIG. 2*a* depicts carton blank 48 as being erected prior to sealing of its closure flaps, and as including no articles. Also, carton blank 48 is shown in an opened position such that the minor flaps 32 and the major flaps 30 are substantially unbent so that articles can be easily inserted into carton blank 48. FIG. 2*b* depicts the carton blank 48 after the articles (e.g., 26) have been inserted and after both the minor flaps 32 and major flaps 30 have been bent into final position. More particularly, minor flaps 32 are shown as being closed and conforming around the articles, and major flaps 30 are shown as being then closed against minor flaps 32 to hold minor flaps 32 securely against the articles. An adhesive or fastener might be provided to maintain some connection between major flaps 30 and minor flaps 32 and to seal the completed container with its contained articles.

As can be seen in FIGS. 2*a* and 2*b*, carton blank 48 can remain at least partially open so that some portion of the contained articles can be visible from outside the carton blank (e.g., through one or more windows or open areas in the carton blank). This type of partially-open carton blank can be desirable for marketing purposes as well as for reducing the amount of material (e.g., cardboard or paperboard) that is needed to package a group of articles. When minor flaps 32 are fully and properly bent against the articles and are held in a fixed position while an adhesived major flap 30 is then fully and properly bent and held against minor flaps 32 until the adhesive sets, the resultant package can exhibit extraordinary strength, rigidity, and holding power for the articles contained therein, while enabling significant exposure for marketing and aesthetic purposes.

As shown in FIGS. 2*a*–2*b*, carton blank 48 has flaps 30 and 32 located near the bottom of carton blank 48, while a window 33 is provided near the top of carton blank 48 through which the contained articles can be seen. However, alternate carton blanks can be used with a vertical sleeve sealer apparatus in accordance with the present invention. For example, these alternate carton blanks might involve flaps disposed near the top of the carton blank and a window near the bottom of the carton blank. Alternatively, flaps might be provided both at the top and the bottom of a carton blank with one or more windows provided toward the middle of the carton blank. As still another alternative, a carton blank might not involve any window whatsoever. Furthermore, although carton blank 48 is shown to have rounded corners and a variety of other specific characteristics, it should be appreciated that any of a variety of other carton blanks could alternatively be used with an exemplary vertical sleeve sealer apparatus, including those that might, for example, have squared or angular features.

Turning back to FIG. 1, after group 36 is associated with carton blank 48 and the vacuum placement system 38 ceases its vacuum application to carton blank 48, dead plate 54 can be moved downwardly (e.g., by a pneumatic piston assembly) and a placement device 66 (e.g., actuated by a pneumatic piston assembly) can push the associated carton blank and group along a base plate 76 toward a vertical sleeve sealer apparatus 100. During this movement, guide rails 56 can retain and direct the associated carton blank and group as they are moved toward vertical sleeve sealer apparatus 100. Also, during this movement, glue applicators such as nozzles 52 can apply adhesive to one or more of the flaps (e.g., major flaps 30) of the carton blank. However, in an another embodiment, the adhesive might alternatively be applied to the flaps (e.g., major flaps 30) after the carton blank has reached the vertical sleeve sealer apparatus 100 or after the carton blank has begun its vertical travel through the channel 112 (shown in FIG. 3) of the vertical sleeve sealer apparatus 100.

The adhesive can be selected from any of a variety of suitable adhesive products and can, for example, comprise a glue having a contact dwell time for curing of between about four seconds and about five seconds, which will be discussed more below. Nozzles 52 can be activated in response to the detection of the passing carton blank by a proximity sensor 62 (e.g., a photo eye, inductive sensor, capacitive sensor, light curtain, magnetic switch, or a contact switch), for example. In an alternate setup, a vision system could be used to detect the presence of a flap for deposition of adhesive, or the physical presence of a flap might mechanically trigger adhesive application. Similarly, pressure sensitive or heat actuated adhesives, for example, might be placed on a carton blank prior to this time, obviating a need to apply adhesives as the loaded sleeve approaches the sleeve sealer apparatus. It should therefore be appreciated that the adhesives discussed herein for attaching respective sections of a carton blank can include any of a variety of glues, tapes, fasteners, welds, interlocking tabs, and/or other specific products or arrangements, and that these adhesives can be applied to a carton blank using any of a variety of known techniques.

An associated carton blank and group of articles can be horizontally moved by placement device 66 until it reaches an end wall or stopper 86 that is associated with vertical sleeve sealer apparatus 100. End wall 86 can be located in order that the associated carton blank and group is appropriately aligned for passage downwardly through a channel 112 of vertical sleeve sealer apparatus 100. In this example, a proximity sensor 64 (e.g., a photo eye, inductive sensor, capacitive sensor, light curtain, magnetic switch, or a contact switch) can detect when the associated carton blank and group has reached end wall 86 and is accordingly ready for travel through channel 112.

Referring now to FIGS. 1 and 3, an associated carton blank and group (e.g., 50) that has reached end wall 86 can be pressed downwardly (e.g., by ram 124) through channel 112. While the carton blank and its contents might move into and through vertical sleeve sealer apparatus 100 by virtue of its weight and gravity alone, it may be advantageous to include an assist arrangement such as a ram 124 to ensure uniform and reliable vertical movement. This exemplary vertical sleeve sealer apparatus 100 is illustrated as including outer walls 102, 104, 106, 108 that are supported upon a base 130 that can be affixed to the ground, for example. Ram 124 can be supported with respect to at least one of the outer walls (e.g., 106) by a ram brace 122, and can include a piston 128 that interfaces a ram head 126. Ram head 126 can directly interface the top of a carton blank for pushing the carton blank and its associated articles downwardly through channel 112.

A deflector assembly can be associated with outer walls 102, 104, 106, 108, and is provided in proximity to the channel 112 through which an associated carton blank and group (e.g., 50) can be moved. A deflector assembly of the present invention can include any device or combination of devices that is/are operative to bend and/or retain one or more flaps of a carton blank. A suitable deflector assembly could include, for example, any of a variety of components such as rollers, pressure saddles, fingers, plows, moving push-arms, and guide assemblies. One or more deflector assemblies can be selected for a particular vertical sleeve sealer apparatus based upon, for example, the precise nature of the carton blank and its flaps and panels to be folded, the desired production speed, the available vertical height, and the contact dwell time of any adhesive used for the flaps of the carton blank.

Although a deflector assembly might be substantially fixed in a single position or otherwise effectively static in nature, it should be appreciated that a deflector assembly might be adjustable or moveable for purposes of fine tuning, or might even be adjustable or moveable to accommodate its use with differently sized or shaped carton blanks. This adjustment might involve the use of shims, bolts, and/or other manually adjustable components. Alternatively, this adjustment might involve the use of an elaborate automatic adjustment device involving racks and pinions and the like.

Furthermore, some deflector assemblies in accordance with the present invention might be configured to be easily replaced (e.g., after they have worn or when a different carton blank is being used), and might accordingly be provided as modular or interchangeable units. In many circumstances, a deflector assembly might remain within a single location during use. However, it should be appreciated that a deflector assembly could alternatively be articulated or otherwise moved by an actuator. Such an actuator could involve electromechanical, pneumatic, hydraulic, spring-loaded and/or any of a variety of other powering devices. It should therefore be appreciated that a deflector assembly in accordance with the teachings of the present invention can assume any of a variety of specific configurations, can be associated with a vertical sleeve sealer apparatus in any of a variety of specific manners and locations, and can perform any of a variety of specific operations upon carton blanks. Some exemplary deflector assemblies are described below in connection with certain specifically disclosed embodiments of vertical sleeve sealer apparatuses in accordance with the teachings of the present invention.

Figure 4:
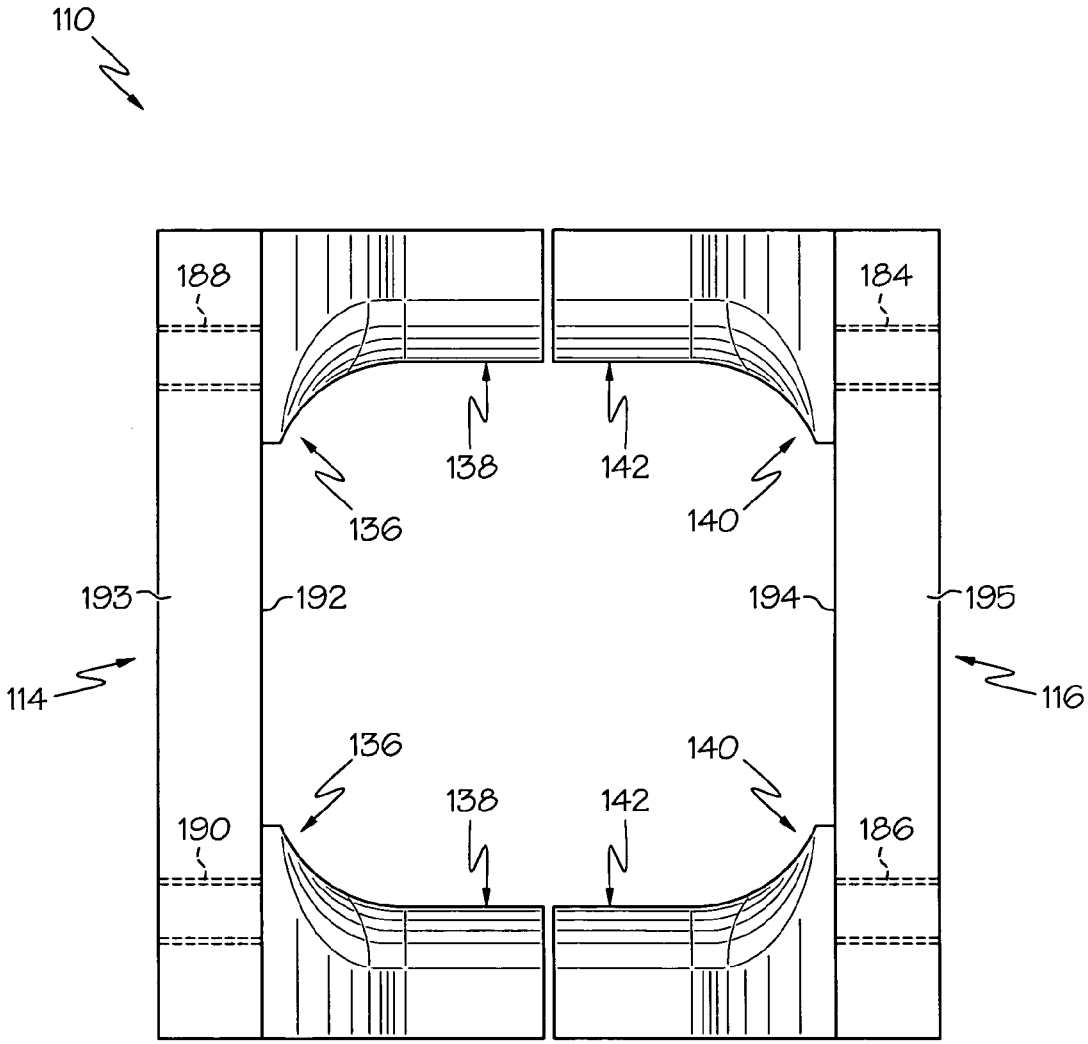
FIG. 4 is a top plan view depicting the exemplary deflector assembly of FIGS. 1 and 3.

As shown in the specific embodiment of FIG. 4, a deflector assembly 110 can include a first plow assembly 114 and a second plow assembly 116. It should be appreciated that an exemplary deflector assembly might alternatively include a single plow assembly, or might otherwise include more than two plow assemblies. A plow assembly can be operative to partially assembly a carton blank around an associated group of articles as the associated carton blank and group is moved vertically through a vertical channel of a vertical sleeve sealer apparatus. For example, a plow assembly can provide a plow function for moving or bending the minor and/or major flaps of passing carton blanks in a sequential assembly and sealing process.

Again referring to FIG. 4, the first and second plow assemblies 114, 116 are shown to be substantially identical, although it should be appreciated that in other embodiments of the present invention, the first and second plow assemblies might be formed differently from each other. The first and second plow assemblies 114, 116 can be formed (e.g., by casting, milling, molding or machining) from aluminum, plastic (e.g., a low-friction polymer such as ultra-high molecular weight or "UHMW" Delrin), fiberglass, an alloy, a composite, and/or any of a variety of other suitable materials. In some embodiments, both of the first and second plow assemblies 114 and 116 can be formed integrally into a solid block of UHMW plastic or aluminum. In another embodiment, as shown in FIG. 4, both of the first and second plow assemblies 114 and 116 can be formed as separate pieces of UHMW plastic or aluminum. Also, it should be appreciated that plow assembly 110 could comprise virtually any number of separate pieces of UHMW plastic or aluminum (as opposed to exactly two as depicted in FIG. 4).

Figure 5A:
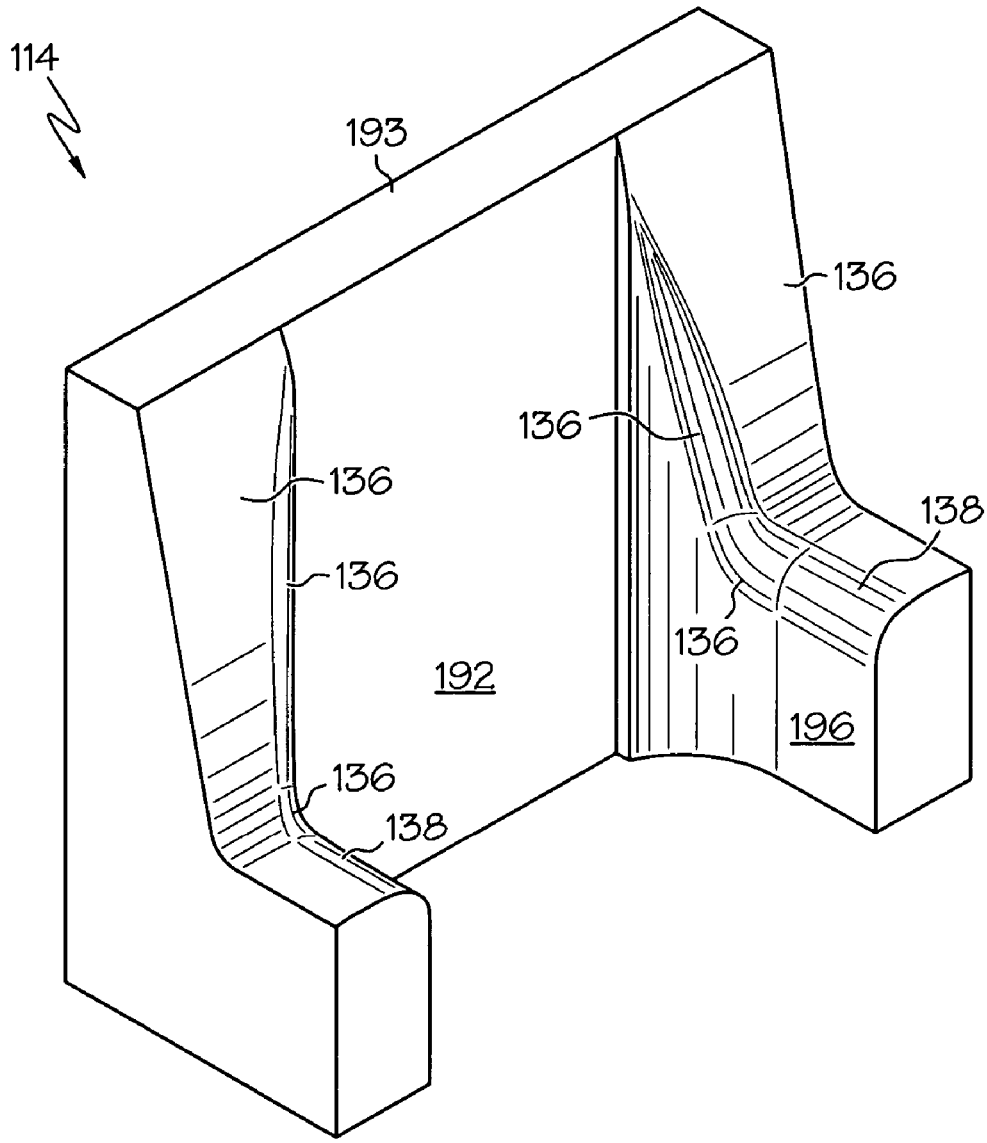
FIG. 5*a* is a top perspective view depicting the exemplary first plow assembly of FIG. 4.
Figure 5B:
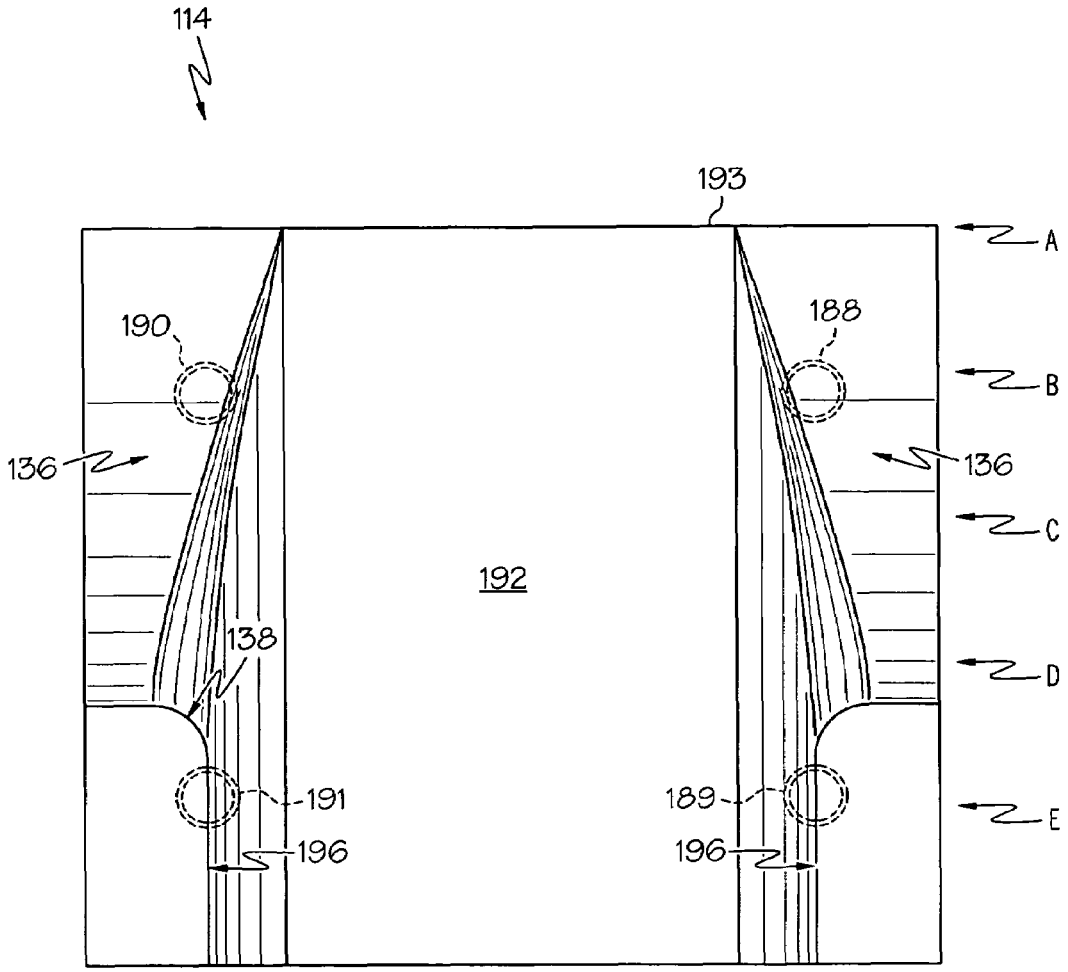
FIG. 5*b* is a front elevational view depicting the exemplary first plow assembly of FIGS. 4 and 5*a;*

Referencing FIGS. 4 and 5*a*–5*b*, first plow assembly 114 is also shown to include a top surface 193 and a substantially flat initial contact surface 192. In an embodiment such as illustrated in FIG. 4, contact surface 192 can be operative to directly interface the side (e.g., 35 in FIG. 2*a*) of a carton blank as the carton blank moves vertically (in this example, downwardly) through deflector assembly 110. Also, first plow assembly 114 can include first drafted portions 136 and second drafted portions 138. First drafted portions 136 comprise a contoured surface which can be provided as compound angular surfaces to facilitate the bending of minor flaps (e.g., 32 in FIG. 2*a*) of a carton blank. Second drafted portions 138 can be similarly provided as an angled surface that can facilitate the bending of major flaps (e.g., 30 in FIG. 2*a*) of a carton blank. As can be best seen in FIG. 5*a*, an additional contact surface 196 can be provided to maintain the major flaps of the carton blank in a desired position (e.g., closed against corresponding minor flaps after the major flaps have been bent into closed position by second drafted portions 138).

Turning back to FIG. 4, second plow assembly 116 is also shown to include a top surface 195 and a substantially flat contact surface 194. Contact surface 194 can be operative to engage a side (e.g., opposite to side 35 of FIG. 2*a*) of the carton blank as the carton blank is moved through deflector assembly 110. Also, second plow assembly 116 can include first drafted portions 140 for bending or folding minor flaps of a carton blank as the carton blank is moved through deflector assembly 110. Second plow assembly 116 can also include second drafted portions 142 for further bending major flaps of the carton blank as the carton blank is moved further downwardly through deflector assembly 110.

Deflector assembly 110 can be associated with a vertical sleeve sealer apparatus in any of a variety of specific configurations and can, for example, include at least one mounting structure that is adapted to interface with a vertical sleeve sealer apparatus. These mounting structures might include, for example, threaded apertures, fasteners, mounting clips, slots, studs, hanger structures and/or any of a variety of alternate mechanically interlocking devices. In the specific embodiment depicted in FIGS. 1 and 3, the first and second plow assemblies 114, 116 can be attached to the outer walls 106, 102 with fasteners. Also, spacers can be provided between the individual plow assemblies 114, 116 and the outer walls 106, 102. The spacers can be replaceable in order that differently sized plow assemblies can be easily and interchangeably associated with vertical sleeve sealer apparatus 100.

Referencing FIGS. 1, 3, 4, 5*b*, and 6*a*–6*e*, first plow assembly 114 is shown as being attached to outer wall 106 by a plurality of fasteners. More particularly, as best seen in FIGS. 6*a*–6*e*, a fastener 156 is shown as being inserted through outer wall 106, through a spacer 148, and into a threaded aperture 188 in first plow assembly 114. Also, a fastener 158 can be inserted through outer wall 106, through a spacer 150, and into another threaded aperture 190 in first plow assembly 114. Additionally, as shown in FIG. 3, a fastener 166 can extend through outer wall 106, through a spacer 162, and into yet another threaded aperture 191 of first plow assembly 114. Yet another fastener (not shown) can extend through outer wall 106, through a spacer and into a threaded aperture 189 of first plow assembly 114. Additional threaded apertures and/or alternative attachment structures might be provided to maintain first plow assembly 114 in association with one or more outer walls (e.g., 102, 104, 106 and/or 108).

Second plow assembly 116 is shown in FIGS. 6*a*–6*e* as being associated with outer wall 102 in a similar manner. More particularly, a fastener 154 can be inserted through outer wall 102, through a spacer 146, and into a threaded aperture 186 of second plow assembly 116. Also, a fastener 152 can be inserted through the second wall 102, through a spacer 144, and into a threaded aperture 184 of second plow assembly 116. Additionally, as shown in FIG. 3, a fastener 164 can be inserted through outer wall 102, through a spacer 160, and into another threaded aperture of second plow assembly 116. Furthermore, another fastener (not shown) might also be inserted through outer wall 102, through a spacer, and into yet another threaded aperture of second plow assembly 116. Additional threaded apertures and/or alternative attachment structures might be provided to maintain second plow assembly 116 in association with one or more outer walls (e.g., 102, 104, 106 and/or 108). Also, although the first and second plow assemblies 114, 116 are depicted as being similarly associated with outer walls (e.g., 106, 102), it should be appreciated that plow assemblies of a particular deflector assembly could alternatively be attached to one or more outer walls or other supportive structures of a vertical sleeve sealer apparatus in any convenient and reliable manner.

As best seen in FIG. 3, channel 112 can extend along a longitudinal axis (e.g., L) from the entrance 132 of channel 112 to the exit 134 of channel 112. A deflector assembly (e.g., 110) and/or a first plow assembly (e.g., 114) might be provided to extend substantially continuously along this longitudinal axis L from the entrance 132 of channel 112 to the exit 134 of channel 112. Such a deflector assembly and/or plow assembly might be sufficiently sizeable as to render it difficult and/or expensive to manufacture, store and install. Accordingly, deflector assembly 110 is depicted in FIG. 3 as extending vertically a distance only slightly greater than is necessary to bend all of the minor flaps and major flaps of a single carton blank.

However, a guide assembly 117 is shown as being disposed immediately below deflector assembly 110. Guide assembly 117 can include a plurality of guide members (e.g., first guide member 118 and second guide member 120) that can be operative to maintain pressure upon the already bent flaps of a carton blank (e.g., to facilitate setting of an adhesive on the flaps) that is moving downwardly through channel 112. Unlike deflector assembly 110 which incorporates many angled surfaces for bending flaps, guide assembly 117 might only include substantially flat or possibly slightly tapered surfaces for maintaining the already bent flaps in their bent position and/or for applying friction to one or more carton blanks within channel 112. By maintaining the adjacent flaps in appropriate contact for a predetermined "dwell" time, the flap seals can be adequately and reliably completed as the now assembled container moves vertically along channel 112. The length of time needed for this "dwell" can be matched to the adhesive materials, flap sizes, carton blank specifications, process speed, and other variables of this type to ensure adequate attachment and sealing of the folded flaps in order to close the container as desired.

In the particular embodiment of FIG. 3, first and second guide members 118 and 120 are depicted as contacting both un-flapped sides (e.g., side 35 shown in FIG. 2*a*) of carton blanks/sleeves that pass through channel 112. These guide members 118 and 120 can provide sufficient friction upon passing carton blanks that such carton blanks can be prohibited from uncontrolled falling under force of gravity. However, this friction can be overcome naturally by the weight of the filled carton blanks being sealed, and/or when ram 124 depresses (directly or indirectly) the carton blank(s). What is not shown in FIG. 3 is that guide assembly 117 might additionally include at least two additional guide members that contact the other two sides (i.e.: the flapped sides) of passing carton blanks. These additional guide members, in addition to providing the aforementioned friction, may also provide sufficient pressure upon the folded major and minor flaps to maintain them in their bent and closed positions until such time as any interconnecting adhesive sufficiently sets.

Although a guide assembly can be associated with vertical sleeve sealer apparatus 100 in any of a variety of specific configurations, the first and second guide members 118, 120 of guide assembly 117 are shown in FIG. 3 to respectively attach to the outer walls 106, 102 with fasteners. More particularly, a fastener 182 (e.g., a stainless steel bolt) is shown to pass through the outer wall 106, through a spacer 174, and into a threaded aperture (not shown) of the first guide member 118. Similarly, another fastener 180 is shown to pass through the outer wall 106, through a spacer 172, and into a threaded aperture (not shown) of the first guide member 118. Likewise, a fastener 176 is shown to pass through the outer wall 102, through a spacer 168, and into a threaded aperture (not shown) of the second guide member 120. Additionally, a fastener 178 is shown to pass through the outer wall 102, through a spacer 170 and into a threaded aperture (not shown) of the second guide member 120. Additional guide members as discussed above might be respectively associated with outer walls 104, 108 in a similar manner. In other embodiments, the guide members might alternatively be associated with the outer walls in a different manner (e.g., not involving fasteners).

Figure 6A:
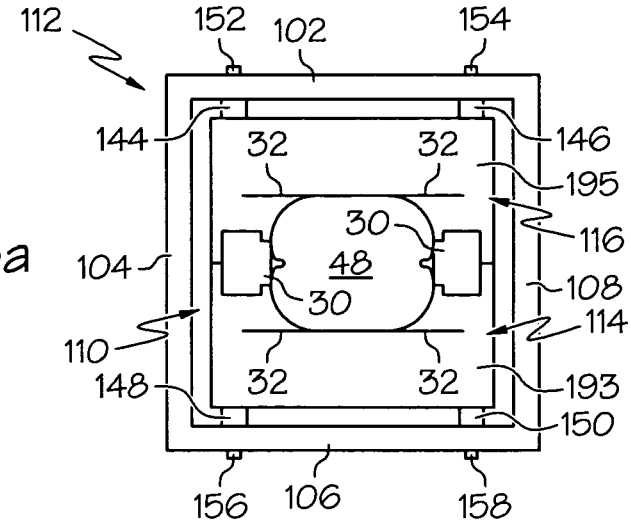
FIG. 6*a* is a top plan view of the carton blank of FIG. 2*a* including a group of articles and being set atop the channel of the exemplary vertical sleeve sealer apparatus of FIGS. 1 and 3, wherein the bottom surface of the carton blank is approximately aligned with position "A" of the first plow assembly as shown in FIGS. 3 and 5*b;*

Referring again to FIGS. 1 and 3, when an associated carton blank and group are pushed vertically downwardly through channel 112 by ram 124, the minor and major flaps of the carton blanks are folded or bent inwardly and are accordingly closed, thereby securing the articles within the carton blank. This bending process is shown in further detail in FIGS. 6*a*–6*e*, wherein the carton blank of FIGS. 2*a* and 2*b* is shown as being depressed downwardly through vertical sleeve sealer apparatus 100 of FIGS. 1 and 3. However, for simplification and clarity of illustration, certain components of packaging system 16, such as ram 124, ram brace 122, end wall 86, guide rails 56 and base plate 76 are not depicted in FIGS. 6*a*–6*e*. Turning first to FIG. 6*a*, carton blank 48 is depicted at a vertical position along axis L such that the bottom surface (e.g., 31 of FIG. 2*b*) of carton blank 48 has not substantially entered deflector assembly 110 and is accordingly approximately aligned with position "A" along axis L (as indicated in FIGS. 3 and 5*b*). When carton blank 48 is in this position, its minor flaps 32 and major flaps 30 remain substantially unbent.

Figure 6B:
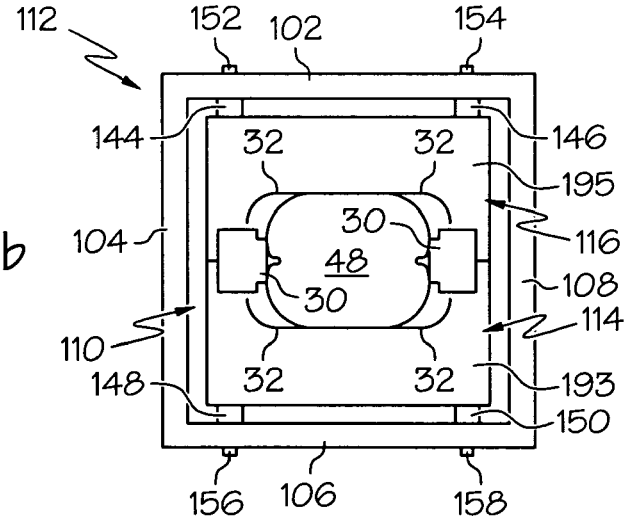
FIG. 6*b* is a top plan view of the carton blank of FIG. 2*a* including a group of articles and being moved downwardly into the channel of the exemplary vertical sleeve sealer apparatus of FIGS. 1 and 3 until the bottom surface of the carton blank is approximately aligned with position "B" of the first plow assembly as shown in FIGS. 3 and 5*b;*
Figure 6C:
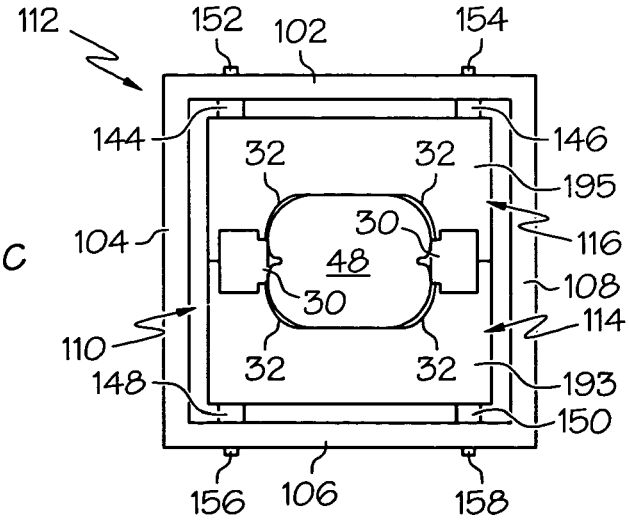
FIG. 6*c* is a top plan view of the carton blank of FIG. 2*a* including a group of articles and being moved downwardly into the channel of the exemplary vertical sleeve sealer apparatus of FIGS. 1 and 3 until the bottom surface of the carton blank is approximately aligned with position "C" of the first plow assembly as shown in FIGS. 3 and 5*b;*
Figure 6D:
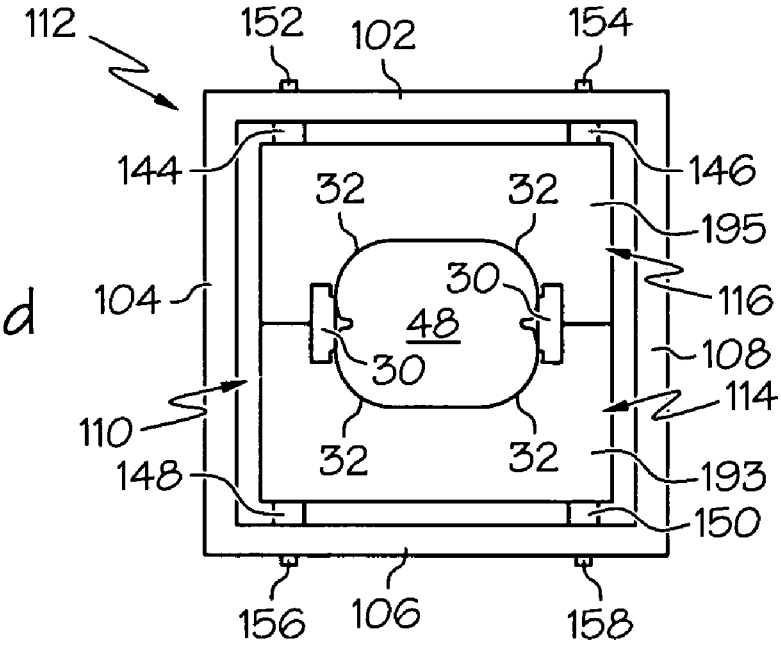
FIG. 6*d* is a top plan view of the carton blank of FIG. 2*a* including a group of articles and being moved downwardly into the channel of the exemplary vertical sleeve sealer apparatus of FIGS. 1 and 3 until the bottom surface of the carton blank is approximately aligned with position "D" of the first plow assembly as shown in FIGS. 3 and 5*b;*
Figure 6E:
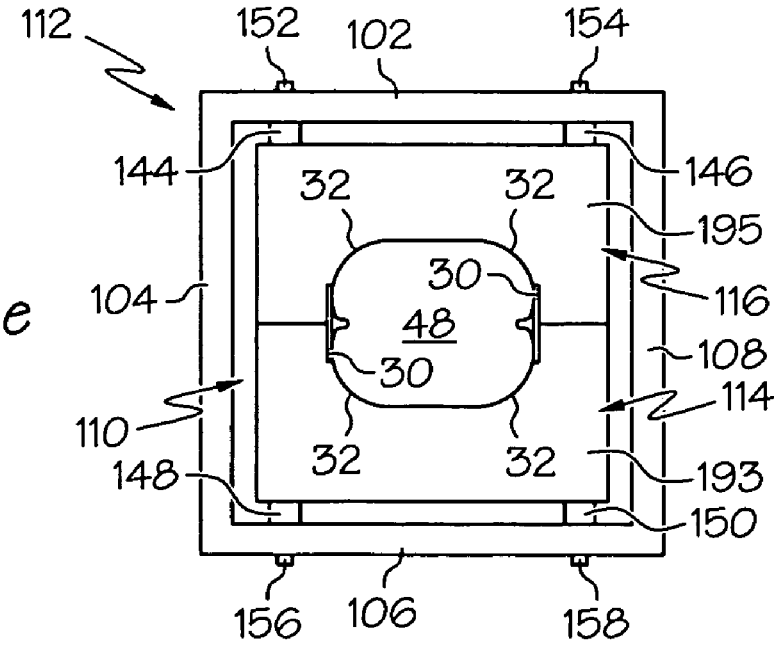
FIG. 6*e* is a top plan view of the carton blank of FIG. 2*a* including a group of articles and being moved downwardly into the channel of the exemplary vertical sleeve sealer apparatus of FIGS. 1 and 3 until the bottom surface of the carton blank is approximately aligned with position "E" of the first plow assembly as shown in FIGS. 3 and 5*b;*

As carton blank 48 moves downwardly through channel 112 (e.g., under pressure from ram 124) such that the bottom surface (e.g., 31 of FIG. 2*b*) of carton blank 48 approaches position "B" along axis L (as indicated in FIGS. 3 and 5*b*), minor flaps 32 are bent inwardly (e.g., by first tapers 136, 140 shown in FIG. 4), although major flaps 30 remain substantially unbent, as shown in FIG. 6*b*. As carton blank 48 is pressed further downwardly through deflector assembly 110 such that its bottom surface (e.g., 31 of FIG. 2*b*) approaches position "C" along axis L (as indicated in FIGS. 3 and 5*b*), minor flaps 32 are bent further inwardly (e.g., by first tapers 136, 140 shown in FIG. 4), while major flaps 30 remain substantially unbent, as shown in FIG. 6*c*. As carton blank 48 is pressed further downwardly through deflector assembly 110 such that the bottom surface (e.g., 31 of FIG. 2*b*) of carton blank 48 approaches position "D" along axis L (as indicated in FIGS. 3 and 5*b*), minor flaps 32 are substantially entirely bent into position while major flaps 30 begin to be bent against minor flaps 32 (e.g., by second tapers 138, 142 shown in FIG. 4), as shown in FIG. 6*d*. As carton blank 48 is pushed still further vertically downwardly through deflector assembly 110 such that the bottom surface (e.g., 31 of FIG. 2*b*) of carton blank 48 approaches position "E" along axis L (as indicated in FIGS. 3 and 5*b*), major flaps 30 are fully bent against minor flaps 32 (e.g., by contact surfaces 196 shown in FIG. 5*b*) which are also fully bent, as shown in FIG. 6*e*. As the carton blank 48 is moved still further downwardly through channel 112, major flaps 30 and minor flaps 32 can be maintained in their bent positions (e.g., by contact surfaces 196 as shown in FIG. 5*b* and/or by guide assembly 117 as shown in FIG. 3) until such time as the adhesive that had been previously applied to the major flaps by the nozzles 52 can sufficiently dry or set.

Turning back to FIGS. 1 and 3, it is contemplated that a plurality of associated carton blanks and groups (e.g., 50, 88, 90, 92) can be disposed within channel 112 of vertical sleeve sealer apparatus 100 at any given time. Hence, while ram 124 pushes an associated carton blank and group 50 (e.g., as discussed previously) vertically downwardly through channel 112, an immediately subjacent carton blank and group 88 that had been previously loaded into channel 112 can be correspondingly pushed downwardly. After pushing the associated carton blank and group 50 into the channel, ram 124 can retract (e.g., upwardly) so that it can be ready to push a subsequent associated carton blank and group through the channel. Accordingly, ram 124 might extend only so far as necessary to fully insert one associated carton blank and group into channel 112. However, in alternate embodiments, a ram might be provided that can extend even further. For example, by extending substantially the entire length of the channel, a ram can "clean out" the channel by pushing out all carton blanks and/or residue therein.

In fact, as will be understood, depending on the length of channel 112, any number of associated carton blanks and groups of articles can be stacked within the channel, with all of the subjacent in-process containers being pushed vertically simultaneously. As discussed above, it is contemplated that deflector assembly 110 and guide assembly 117 can provide sufficient compression and resulting friction upon the associated carton blanks and groups 50, 88, 90, 92 such that they will not uncontrollably fall out of channel 112 under force of gravity alone, but rather will only fall out of channel 112 under application of force (e.g., from ram 124). However, in another embodiment, no ram may be required for pushing associated carton blanks and groups through the channel, but gravity alone may be sufficient to achieve this result. In such an embodiment, any guide assembly might only provide sufficient pressure upon the carton blank(s) to delay their fall (e.g., to an exit conveyor). Brakes or detents (e.g., spring loaded wedges) might also or alternatively be provided within the channel in order to control movement or progression of the "stack" of containers through the channel. In either embodiment, an associated carton blank and group (e.g., 92) can remain within channel 112 during a plurality of packaging cycles as discussed above. In this manner, the major and minor flaps of each carton blank can be held in place for a sufficient time until any interconnecting adhesive sets.

As discussed above, FIG. 3 depicts a channel 112 that is sufficiently elongated to simultaneously contain three of four associated carton blanks and groups such that pressure can be simultaneously applied to the flaps of each carton blank while adhesive sets. It should be appreciated, however, that an exemplary vertical sleeve sealer apparatus might include a channel that can include additional or fewer such associated carton blanks and groups. For example, if the packaging rate is increased and/or a slower setting adhesive is applied to the major flaps, then the channel might be lengthened in order that an associated carton blank and group can be retained within the channel for a longer period of time so that the adhesive can set. However, if the packaging rate is decreased and/or a faster drying adhesive is applied to the major flaps, then the channel can be shortened while still providing ample holding time for each carton to facilitate adequate drying time for the adhesive.

When an associated carton blank and group reaches the end of channel 112, it can in some embodiments be deposited directly onto an exit conveyor 46. For example, as shown in FIGS. 1 and 3, a packaged group 68 of articles can then move along the exit conveyor 46 for further processing if necessary. The exit conveyor of FIGS. 1 and 3 is shown to simply comprise a substantially flat moving belt that is operative to support packaged groups (e.g., 68) as they are moved onward for possible further processing. It should be appreciated, however, that guide rails (not shown) might be provided on each side of an exit conveyor along at least part of the travel length of the exit conveyor. These guide rails can provide additional pressure upon the major and minor flaps of a packaged group as the packed group is moved along the exit conveyor. If an exit conveyor is provided with these guide rails, then packaged groups can be released from channel 112 even before any flap adhesive fully sets, as the adhesive can finish setting while the packaged groups are moving within the guide rails on the exit conveyor. As yet another alternative, in lieu of the guide rails, an exit conveyor can be fitted with multiple forms or boxes (not shown) that are spaced along the moving belt of an exit conveyor. Such an exit conveyor can be synchronized with ram 124 so that each form can "catch" a packaged group as the packaged group is dispensed from channel 112. The form can be designed to provide continued pressure upon the major and minor flaps of the packaged group's carton blank to facilitate ongoing setting of any adhesive.

Figure 7:
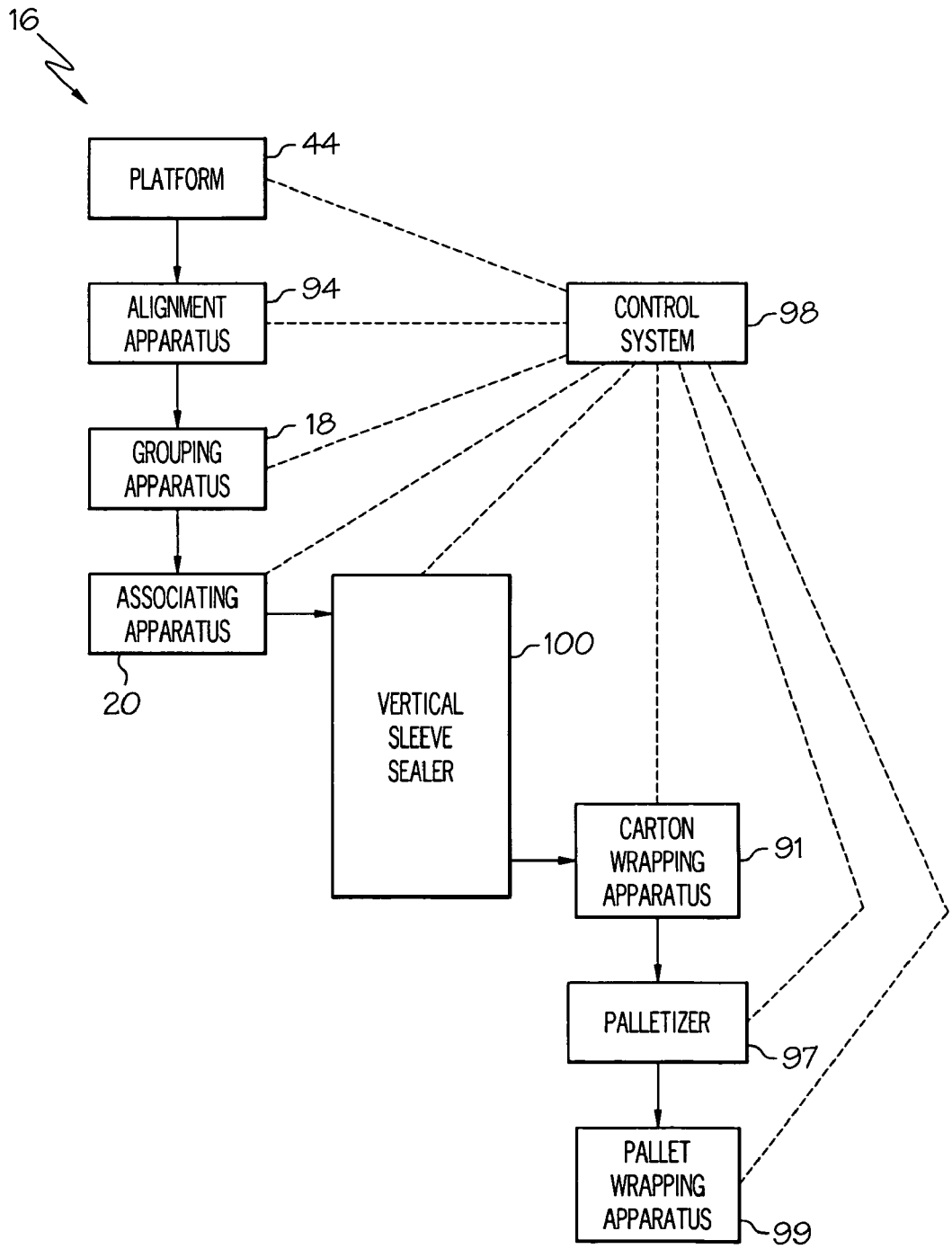
FIG. 7 is a simplified schematic diagram depicting an exemplary packaging system of the present invention including a vertical sleeve sealer apparatus in accordance with one exemplary embodiment of the present invention.

FIG. 7 depicts a schematic representation of a vertical sleeve sealer 100 in use as part of a packaging system 16. More particularly, platform 44 is depicted for receiving articles to be packaged. In this example, alignment apparatus 94 is operative to receive articles from platform 44 and to at least initially align the articles (e.g., into rows and/or columns). Grouping apparatus 18 can then separate these aligned articles from alignment apparatus 94 into a group (e.g., group 36 in FIG. 1). An associating apparatus 20 then receives the group of articles from the grouping apparatus 18 and associates that group with a carton blank (e.g., by sliding those articles into a partially formed and erected carton blank). The associated carton blank and group are then moved onward (e.g., by placement device 66 shown in FIG. 1) to vertical sleeve sealer apparatus 100.

After an associated carton blank and group pass through vertical sleeve sealer apparatus 100 and are accordingly formed into a packaged group (e.g., 68 in FIG. 1), the packaged group 68 can be received and carried away by an exit conveyor (e.g., 46 in FIG. 1). In some embodiments, a packaged group can then be wrapped by a carton wrapping apparatus 91 that can, for example, provide shrink-wrap plastic around the packaged group. Packaged groups, regardless of whether they have been wrapped by a carton wrapping apparatus, can then be stacked onto pallets by a palletizer 97. A pallet wrapping apparatus 99 can be provided to wrap a pallet of packaged groups with plastic or another film for shipping.

A control system 98 can be provided to monitor and/or control one or more components of packaging system 16. This control system can include software, algorithms and/or hardware to synchronize one or more components of packaging system 16 such that various aspects/elements of packaging system 16 can be effectively and synchronously started, stopped, cycled, interrupted, and/or varied in speed and/or operation. An operator interface (e.g., including buttons, switches, potentiometers, displays, and/or a touch-screen) might also be provided to facilitate an operator's interaction with control system 98 and the resultant operation of packaging system 16.

Figure 8:
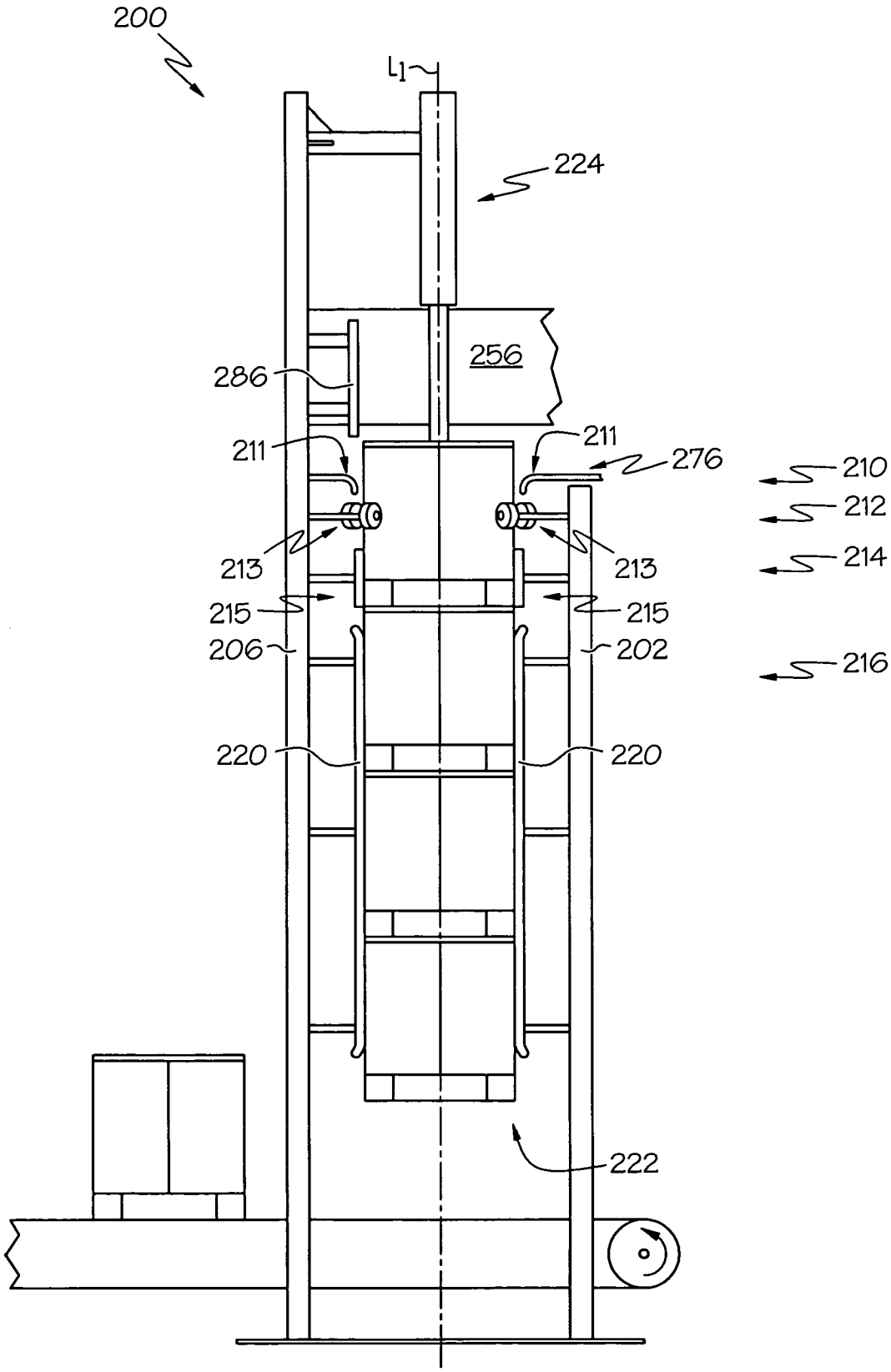
FIG. 8 depicts a partial sectional side elevational view of a vertical sleeve sealer apparatus in accordance with another exemplary embodiment of the present invention.

Turning now to FIG. 8, an alternate vertical sleeve sealer apparatus 200 is depicted. Vertical sleeve sealer apparatus 200 is shown as being similar to vertical sleeve sealer apparatus 100 of FIG. 3 except that vertical sleeve sealer apparatus 200 is depicted as including alternate deflector assemblies (e.g., 211, 213, 215, 220) in accordance with the teachings of the present invention. More particularly, vertical sleeve sealer apparatus 200 is shown to include multiple levels of deflector assemblies (e.g., 210, 212, 214, 216) that are spaced from each other along the vertical longitudinal axis ($L_1$) of channel 222. For example, a first level 210 can include fingers 211 which can begin bending the minor flaps of a carton blank as the carton blank is moved downwardly through the channel 222. In one embodiment (as shown in FIG. 8), these fingers 211 can be integral with a base plate 277 upon which a carton blank is moved from an associating apparatus. However, in other embodiments, fingers can be removeably associated with either base plate 276 and/or one or more other components of vertical sleeve sealer apparatus 200, such as outer walls (e.g., 202 and/or 206). In the embodiment depicted in FIG. 8, fingers 211 are depicted as being substantially stationary and rigidly positioned. It should be appreciated, however, that fingers might alternatively be moveable and/or replaceable. Adjustable, flexible, reciprocable and/or replaceable fingers can be advantageous for providing flexibility to a vertical sleeve sealer apparatus in order that it can accommodate multiple sizes and/or shapes of carton blanks. Also, the fingers might be selectively articulated by one or more pneumatic, hydraulic, mechanical, electromechanical or other type of actuator in order that the fingers can, for example, operate upon a carton blank at only certain times. Such articulating fingers can be particularly useful for carton blanks that have protrusions or irregular shapes that would otherwise interfere with fingers having a fixed position.

As the carton blank is moved further downwardly, it reaches a second level 212 of deflector assemblies. This second level is shown to include one or more roller assemblies 213. These roller assemblies are shown as being able to further bend the minor flaps of a passing carton blank. As shown, roller assemblies 213 each comprise two respective roller wheels for providing simultaneous application of pressure upon two portions of each minor flap being bent. This simultaneous application of pressure helps to ensure that the minor flap is bent squarely and tightly. In another embodiment, however, a roller assembly might comprise a single roller wheel that is tapered so as to provide a similar simultaneous application of pressure to a minor flap. One or more roller assemblies might also or alternatively be provided to maintain pressure upon the side surfaces of a carton blank within channel 222, and/or might even be provided to facilitate bending of the major flap(s) of a carton blank. Although roller assemblies 213 are depicted in FIG. 8 as having a fixed position, it should be appreciated that roller assemblies in accordance with the present invention might be replaceable, adjustably positioned and/or articulated as discussed previously.

As the carton blank is moved still further downwardly, a third level 214 of deflector assemblies is encountered. This third level 214 is shown to include one or more pressure saddles 215 that can be operative to maintain pressure upon the already-bent minor flaps of a passing carton blank. These pressure saddles can include tapered surfaces having predetermined draft angles for providing uniform pressure to bent or folded flaps of a carton blank being moved through the channel. As the carton blank is moved even further downwardly, a fourth level 216 of deflector assemblies is shown to be encountered. This fourth level 216 is shown to include one or more vertically elongated guide members 220 that can be operative to maintain pressure upon one or more portions of the passing carton blanks. Although FIG. 8 depicts pressure saddles 215 and guide members 220 as being separately provided, it should be appreciated that they could alternatively be provided as a single integral structure. Furthermore, it should be understood that at least one of pressure saddles 215 and guide members 220 can be removeably attached to the outer walls (e.g., to facilitate adjustment or replacement), and/or can be flexible or movable with respect to the outer walls 202, 206 (e.g., by an operator or by an actuator).

As previously indicated, a vertical sleeve sealer apparatus in accordance with the principles of the present invention can include any of a variety of deflector assemblies that are oriented in any of a variety of specific configurations and that are located at any of a variety of vertical levels or positions along the channel. A vertical sleeve sealer apparatus can accordingly include any combination of plows, rollers, deflectors, fingers, and/or any other components that can facilitate the bending and holding of flaps in a desired position and for a desired duration (e.g., until adhesive sets). While one exemplary vertical sleeve sealer apparatus might only include a single deflector assembly having one or more plow assemblies (e.g., as shown in FIG. 3), another vertical sleeve sealer apparatus might include multiple deflector assemblies that each include only fingers and/or rollers.

The exemplary vertical sleeve sealer apparatuses described above are configured such that the flaps of a carton blank are folded as the carton blank is moved downwardly through a channel. It should be appreciated that a vertical sleeve sealer apparatus in accordance with the teachings herein might also be operative to fold the flaps of a carton blank as the carton blank is moved upwardly through a channel. In some specific embodiments, a vertical sleeve sealer apparatus might be operative to move a single carton blank both vertically upwardly to bend some flaps and vertically downwardly to bend other flaps. Regardless of the direction of vertical travel, it should be understood that a packaging system might include multiple vertical sleeve sealer apparatuses, wherein these apparatuses may or may not involve the same direction of vertical carton blank travel.

The foregoing description of exemplary embodiments and examples of the invention has been presented for purposes of illustration and description. These examples and descriptions are not intended to be exhaustive or to limit the invention to the forms described. Numerous modifications are possible in light of the above teachings. Some of those modifications have been discussed, and others will be understood by those skilled in the art. It is hereby intended that the scope of the invention be defined by the claims appended hereto.

What is claimed is:

1. A method of packaging a group of articles into a container formed from a carton blank, the method comprising:

associating a partially erected carton blank with a group of articles, said carton blank having a top panel, a bottom panel, a first side panel, a second side panel, a plurality of unbent major flaps extending from the bottom panel, and a plurality of unbent minor flaps extending from each of the first side panel and the second side panel, wherein the first side panel and the second side panel connect the bottom panel with the top panel such that the top panel is substantially parallel with the bottom panel and is spaced from the bottom panel, and such that the first side panel is substantially parallel with the second side panel and is spaced from the second side panel;

providing a vertically oriented channel having at least one deflector assembly; and moving said associated carton blank and group vertically through said channel in a single direction perpendicular to a plane defined by the bottom panel, whereby said movement results in the maintaining of said side panels in their position relative the bottom and top panels throughout a portion of the channel corresponding to said deflector assembly and bending of said major flaps and said minor flaps by said deflector assembly such that said carton blank is substantially fully assembled around said group before said associated carton blank and group exit the channel.

2. The method of claim 1, wherein the associating step involves inserting the group into the partially erected carton blank.

3. The method of claim 1, further comprising the step of placing adhesive on the partially erected carton blank before the partially erected carton blank is moved into the channel.

4. The method of claim 3, wherein said movement of the carton blank through the channel results in maintaining said major flaps and said minor flaps in a bent position until said adhesive sets.

5. The method of claim 1, wherein said moving step involves moving said associated carton blank and group vertically downwardly within said channel.

6. The method of claim 1, further comprising the step of providing a ram to assist in moving said associated carton blank and group vertically along said channel.

7. The method of claim 1, wherein said deflector assembly comprises at least one of a plow assembly, a roller, a finger and a pressure saddle.

8. The method of claim 1, wherein said channel is provided with a plurality of deflector assemblies.

9. The method of claim 1, further comprising the step of providing pressure to one or more of said flaps as the associated carton blank and group moves along said channel.

10. The method of claim 9, wherein said pressure is applied by one or more vertically elongated guide members.

11. An apparatus for packaging a group of articles in a container formed from a carton blank, the apparatus comprising:

apparatus for associating a group of articles with a partially erected carton blank;

a vertical channel having first and second ends disposed along a substantially vertical longitudinal axis, the first end comprising an entrance to said channel and the second end comprising an exit from said channel, said entrance being configured to receive said partially erected carton blank associated with a group of articles, the carton blank having a top panel, a bottom panel, a first side panel, a second side panel, a plurality of unbent major flaps extending from the bottom panel, and a plurality of unbent minor flaps extending from each of the first side panel and the second side panel, wherein the first side panel and the second side panel connect the bottom panel with the top panel such that the top panel is substantially parallel with the bottom panel and is spaced from the bottom panel, and such that the first side panel is substantially parallel with the second side panel and is spaced from the second side panel; and a deflector assembly maintaining said side panels in their position relative the bottom and top panels throughout a portion of the channel corresponding to said deflector assembly and provided along the channel, the deflector assembly operative to bend said major flaps and said minor flaps as the associated carton blank and group are moved in a single direction through said channel such that said carton blank is substantially fully assembled around said group before said associated carton blank and group exit the channel, whereby the direction is perpendicular to a plane defined by the bottom panel.

12. The apparatus of claim 11, wherein the deflector assembly comprises at least one of a plow assembly, a roller, a finger, and a pressure saddle.

13. The apparatus of claim 11, wherein said channel further comprises at least two levels being vertically spaced from each other along the longitudinal axis, each level being provided with a deflector assembly.

14. A system for packaging a group of articles into a container formed from a carton blank, the system comprising:

an article grouping apparatus operative to receive articles and to arrange the articles into a predetermined group;

an associating apparatus operative to associate a partially erected carton blank with the group of articles, the carton blank having a top panel, a bottom panel, a first side panel, a second side panel, a plurality of unbent major flaps extending from the bottom panel, and a plurality of unbent minor flaps extending from each of the first side panel and the second side panel, wherein the first side panel and the second side panel connect the bottom panel with the top panel such that the top panel is substantially parallel with the bottom panel and is spaced from the bottom panel, and such that the first side panel is substantially parallel with the second side panel and is spaced from the second side panel; and a vertical sleeve sealer apparatus comprising a vertical channel and at least one deflector assembly associated with the channel, the channel having first and second ends disposed along a substantially vertical longitudinal axis, the first end comprising an entrance to said channel and the second end comprising an exit from said channel, said entrance being configured to receive the associated carton blank and group from the associating apparatus, said deflector assembly maintaining said side panels in their position relative the bottom and top panels throughout a portion of the channel corresponding to said deflector assembly and operative to bend said major flaps and said minor flaps as the associated carton blank and group are moved in a single direction through said channel such that said carton blank is substantially fully assembled around said group before said associated carton blank and group exit the channel, whereby the direction is perpendicular to a plane defined by the bottom panel.

15. The system of claim 14, further comprising a feed conveyor configured to provide the articles to the article grouping apparatus.

16. The system of claim 15, wherein the article grouping apparatus comprises a piston being operative to help arrange the articles into the group by displacing selected articles from the feed conveyor.

17. The system of claim 14, wherein the associating apparatus comprises a vacuum placement system.

18. The system of claim 14, wherein said at least one deflector assembly comprises at least one of a plow assembly, a roller, a finger and a pressure saddle.

19. The system of claim 14, further comprising an alignment apparatus operative to align the articles before the articles are provided to the article grouping apparatus.

20. The system of claim 14, further comprising an exit conveyor located adjacent to said exit and configured to receive the associated carton blank and group from the vertical sleeve sealer apparatus.

21. The system of claim 14, wherein said channel further comprises at least two levels being vertically spaced from each other along the longitudinal axis, each level being provided with a deflector assembly.

22. The system of claim 14, further comprising at least one of a platform, a carton wrapping apparatus, a palletizer, and a pallet wrapping apparatus.

23. The system of claim 14, further comprising a control system configured to operate the vertical sleeve sealer apparatus and one or more of said article grouping and associating apparatuses.

24. A method of packaging a group of articles into a container formed from a carton blank, the method comprising:

associating a partially erected carton blank with a group of articles, said carton blank having a top panel, a bottom panel, a first side panel, a second side panel, a plurality of unbent major flaps extending from the bottom panel, and a plurality of unbent minor flaps extending from each of the first side panel and the second side panel, wherein the first side panel and the second side panel connect the bottom panel with the top panel such that the top panel is substantially parallel with the bottom panel and is spaced from the bottom panel, and such that the first side panel is substantially parallel with the second side panel and is spaced from the second side panel;

providing a vertically oriented channel having at least one deflector assembly; and moving said associated carton blank and group vertically through said channel perpendicularly to a plane defined by the bottom panel such that said carton blank is substantially fully assembled and said major flaps and said minor flaps are folded closely with respect to said group while maintaining of said side panels in their position relative the bottom and top panels throughout a portion of the channel corresponding to said deflector assembly before said associated carton blank and group exit the channel.

25. The method of claim 24, further comprising placing adhesive on at least one of said major flaps and said minor flaps.

* * * * *